US007024720B2

(12) United States Patent
Moskovich et al.

(10) Patent No.: US 7,024,720 B2
(45) **Date of Patent: *Apr. 11, 2006**

(54) TOOTHBRUSH

(75) Inventors: Robert Moskovich, East Brunswick, NJ (US); Joachim Storz, Zell am See (AT); Tanja Langgner, London (GB); Thomas Kuchler, Zell am See (AT)

(73) Assignee: Colgate-Palmolive Company, New York, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/990,350

(22) Filed: Nov. 16, 2004

(65) Prior Publication Data

US 2005/0125925 A1 Jun. 16, 2005

Related U.S. Application Data

(63) Continuation of application No. 10/465,325, filed on Jun. 20, 2003, now Pat. No. 6,817,054.

(60) Provisional application No. 60/402,163, filed on Aug. 9, 2002.

(51) Int. Cl.
*A46B 9/04* (2006.01)

(52) U.S. Cl. ..... 15/167.1; 15/201

(58) Field of Classification Search ..... 15/167.1, 15/201

See application file for complete search history.

(56) References Cited

U.S. PATENT DOCUMENTS 1,840,246 A * 1/1932 Newman ..... 15/167.1
1,860,924 A * 5/1932 Cooke ..... 15/167.1
D102,048 S * 11/1936 Brothers et al. ..... D4/105
2,438,268 A * 3/1948 Bressler ..... 15/167.1
2,443,297 A * 6/1948 Bressler ..... 15/167.1
2,631,320 A * 3/1953 Bressler ..... 15/167.1
2,650,383 A * 9/1953 Bressler ..... 15/167.1
2,676,350 A * 4/1954 Bressler ..... 15/167.1
3,188,672 A * 6/1965 Gary ..... 15/167.1
3,253,292 A * 5/1966 Herschensohn ..... 15/201
4,566,145 A * 1/1986 Wachtel ..... 15/201
5,625,916 A * 5/1997 McDougall ..... 15/28
5,651,158 A * 7/1997 Halm ..... 15/167.1
5,802,656 A * 9/1998 Dawson et al. ..... 15/110
RE35,941 E * 11/1998 Stansbury, Jr. ..... 15/22.2
D401,069 S * 11/1998 Lamond et al. ..... D4/104
5,970,564 A * 10/1999 Inns et al. ..... 15/201
5,991,959 A * 11/1999 Raven et al. ..... 15/201
6,219,874 B1 * 4/2001 van Gelder et al. ..... 15/167.1
D450,929 S * 11/2001 Angelini et al. ..... D4/105
6,886,207 B1 5/2005 Solanki

* cited by examiner

*Primary Examiner*—Mark Spisich
(74) *Attorney, Agent, or Firm*—Harris A. Wolin

(57) ABSTRACT

A toothbrush comprises a handle having an elongated head mounted to the handle. The head has a longitudinally central portion which comprises a plurality of longitudinally aligned segments connected to each other by a joint. Cleaning elements are mounted to the segments and extend outwardly from the outer surface of the head. A shelf-like protrusion extends laterally outwardly from each side of the central section. Further cleaning elements are flexibly mounted to the protrusions. Preferably the shelf-like protrusions are covered with an elastomer. The central section is made of a harder material than the material of the covered protrusions.

17 Claims, 2 Drawing Sheets

TOOTHBRUSH

This is a continuation of U.S. application Ser. No. 10/465,325, filed Jun. 20, 2003, now U.S. Pat. No. 6,817,054, which claimed the benefit of U.S. application Ser. No. 60/402,163, filed Aug. 9, 2002, and which applications are both incorporated by reference in their entirety.

BACKGROUND OF THE INVENTION

The present invention is directed primarily to a manually held and operated toothbrush which includes a handle and a head. Cleaning elements are mounted to the head such as tufts of bristles. When toothpaste is applied to the cleaning elements the user inserts the head into the mouth and brushes the teeth into a known manner.

Conventionally, a toothbrush head is of one piece construction which is elongated and symmetrical in shape on each side of the longitudinal center line. Variations of that basic structure are known in the art. Such variations include forming the toothbrush head with relatively wide segments interconnected by narrow connecting pieces. Reference is made to U.S. Pat. Nos. 1,840,246, 1,860,924, Des. 102,048 and Des. 450,929. Similar type structure has also been incorporated in hairbrushes as exemplified by U.S. Pat. Nos. 3,253,292 and 4,566,145. Other known approaches taken in the prior art include providing some form of flexible mounting for the bristles such as exemplified by U.S. Pat. Nos. 5,802,656, 5,970,564 and 5,991,959. In these approaches an elastomeric section is provided on the longitudinal sides of the central portion of the toothbrush with the longitudinal sections being relatively thick compared to the central portion of the toothbrush and with the elastomer material completely bridging the head as in U.S. Pat. No. 5,970,564 or extending over a significant width of the head and being of generally the same thickness as the thickness of the head as in U.S. Pat. No. 5,991,959. Reference is also made to U.S. Pat. No. Des. 401,069 which appears to illustrate a toothbrush having undulated side edges.

SUMMARY OF THE INVENTION

An object of this invention is to provide a manually held and operated toothbrush which incorporates sections which provide flexibility to the cleaning elements mounted on those sections.

A further object of this invention is to provide such a toothbrush having different sections which mount cleaning elements capable of different motions from one section to the other.

In accordance with this invention an elongated head is attached to the end of a handle. The head has an outer surface with a central section disposed along the longitudinal axis of the head. The central section is in the form of a plurality of segments. The sets of adjacent segments are interconnected by a joint in such a manner that the central section is flexible along the joint for flexing in a manner similar to a caterpillar body. Shelf-like protrusions extend laterally outwardly from the central section. Each protrusion is in the form of a shelf which is generally thinner than the central section. Cleaning elements mounted to the shelf-like protrusions are also capable of flexing or moving but in a motion different than the motion of the cleaning elements on the central section.

In a preferred practice of this invention elastomeric material covers the shelf-like protrusions. The central section is preferably made of a harder material typical of conventional toothbrush material than is the shelf-like protrusions.

THE DRAWINGS

DETAILED DESCRIPTION

Figure 1:
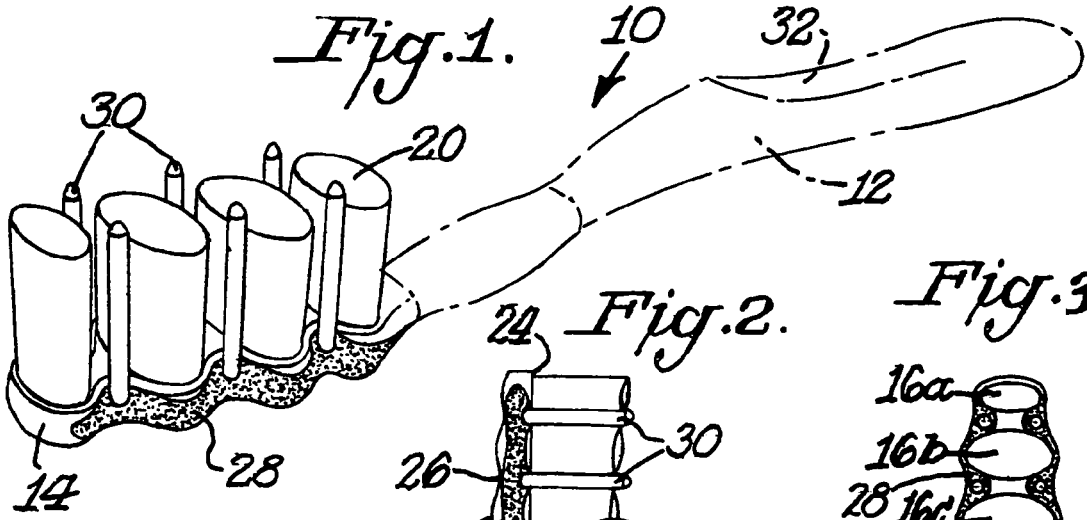
FIG. 1 is a perspective view of a toothbrush formed in accordance with this invention.
Figure 2:
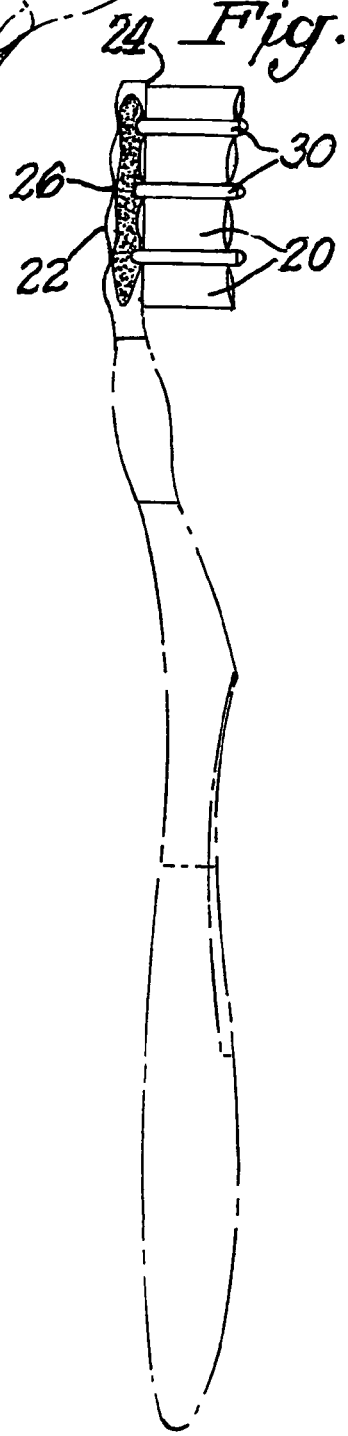
FIG. 2 is a side elevational view of the toothbrush shown in FIG. 1.
Figure 3:
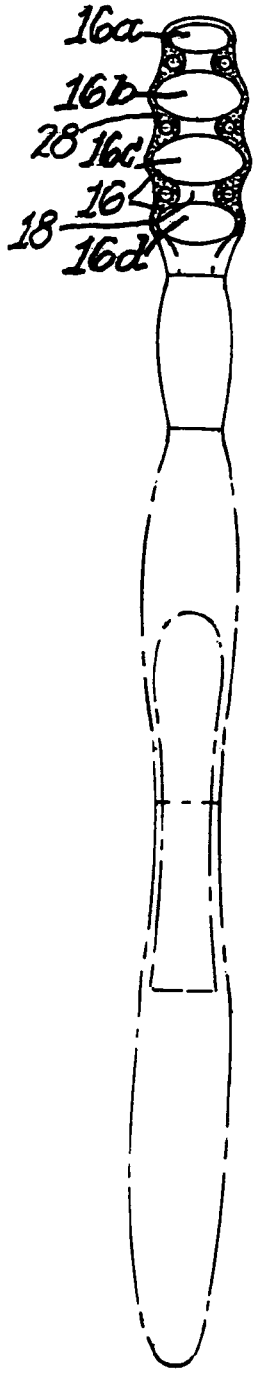
FIG. 3 is a front elevational view of the toothbrush shown in FIGS. 1–2.

FIGS. 1–3 illustrate a toothbrush 10 in accordance with this invention. Toothbrush 10 includes an elongated handle 12 and an elongated head 14 attached to the end of the handle. The head 14 has a longitudinal central section disposed along the longitudinal axis of the head. The central section comprises a plurality of aligned segments 16*a*–*d* each of which is generally oval in shape. See FIG. 3. Each of the segments 16 is connected to an adjacent segment by a joint 18. As best shown in FIG. 3 each joint 18 has an inwardly curved surface extending from one segment to its adjacent segment so that the central portion of each joint 18 is narrower than the remaining portions of joint 18. Similarly, the segments 16 are wider than the joints 18. As a result, the central section is flexible along the joints. When pressure is applied to head 14 during use of the toothbrush 10, head 14 is capable of having a caterpillar-like movement as a result of the structure of segments 16*a*–*d* and connecting joints 18.

As illustrated in FIGS. 1–2 cleaning elements 20 of any suitable form are preferably mounted to the outer surface of segments 16 thereby extending outwardly from the outer surface 24 of head 14.

If desired the face 22 of head 14 on the side of head 14 opposite its outer surface 24 may be of undulated shape as shown in FIG. 2. The narrow portion 26 of these undulations may be located immediately opposite the joints 18 to facilitate flexibility. Alternatively, the narrow portions 26 could be located opposite the segments 16. The outer surface 24 which is comprised of the outer surfaces of segments 16*a*–*d* may be planar, as best illustrated in FIG. 2, or could also have an irregular, such as an undulated shape.

As shown in FIG. 3 the individual segments 16*a*, 16*b*, 16*c* and 16*d* need not be of the same size. Thus, for example, segment 16*c* which is generally at the central portion of head 14 may be of the largest size which would be slightly larger than its adjacent segment 16*b*. Segment 16*d* which is disposed closest to the handle would be slightly smaller in size than segment 16*b*, while distal end segment 16*a* at the narrowest portion of head 14 would be of the smallest size. This arrangement of segment sizes where the smaller sizes are at the ends of head 14 results in the head 14 being generally widest in its central portion and narrowest at its ends.

As illustrated, a shelf-like protrusion 28 extends laterally outwardly from the central section of head 14 on each side of the central section. Additional cleaning elements 30 are preferably mounted on the shelf-like protrusions 28.

In the preferred practice of this invention the outer surface of each shelf-like protrusion and preferably the entire shelf-like protrusion is covered with an elastomeric material so that the cleaning elements 30 are flexibly mounted to the shelf-like protrusions 28. If desired other forms of flexible mounting could be utilized.

Head 14 is thus made with at least two materials. One of the materials used for the central portion having segments 16*a–d* is harder and would be made of conventional toothbrush material. The other material is the elastomer which covers at least the outer surface of shelf-like protrusions 28. The elastomer material provides flexibility. When properly proportioned and integrated with flexible elastomer the head 14 of the toothbrush head is flexible.

The hard plastic portion of the central section is designed with varying cross-sectional areas, as discussed above, that are used to aid flexibility in some of the areas such as the joints 18 and to house or mount the cleaning elements 20 in other areas.

The shelf-like protrusions 28 may be made of hard plastic material extending from and integral with the central section. These protrusions are preferably very thin, such as about 1 mm, and extend from the main or central portion of the hard plastic to create flexible mounts for the cleaning bristles 30. The flexible mounting is enhanced by covering the protrusions 28 with elastomeric material particularly on the outer surface on which the cleaning elements 30 are mounted.

When brushing the main body or central section of the head 14 flexes similar to a caterpillar body. The cleaning elements attached to the shelves 28 also move in different motions attributed to the flexing of the shelf-like protrusion or shelf 28, as well as to the flex of the elastomeric material surrounding the cleaning element concentrations.

The flexibility of the toothbrush head 14 involves a caterpillar-type movement of the segment 16 being flexibly mounted along the longitudinal axis of head 14 while the shelf-like protrusions 28 move in a direction transverse to the longitudinal axis.

As shown in FIG. 3 the elastomeric material on the shelf-like protrusions extends from the peripheral edges of segment 16 and joints 18 outwardly to the end of the protrusions 28 and preferably around the protrusions as shown in FIG. 2.

Any suitable form of cleaning elements may be used as the cleaning elements 20 and 30. The term "cleaning elements" is intended to be used in a generic sense which could include conventional fiber bristles or massage elements or other forms of cleaning elements such as elastomeric fingers or walls arranged in a circular cross-sectional shape or any type of desired shape including straight portions or sinusoidal portions. Where bristles are used, the bristles could be mounted to tuft blocks or sections by extending through suitable openings in the tuft blocks so that the base of the bristles is mounted within or below the tuft block.

It is to be understood that the specific illustration of the cleaning elements is merely for exemplary purposes. The invention can be practiced with various combinations of the same or different cleaning element configurations (such as stapled or in-molded technology bristles, etc.) and/or with the same bristle or cleaning element materials (such as nylon bristles, spiral bristles, rubber bristles, etc.) Similarly, while FIG. 2 illustrates the cleaning elements to be generally perpendicular to the outer surface 24 of head 14 some or all of the cleaning elements may be angled at various angles with respect to the outer surface of head 14. It is thereby possible to select the combination of cleaning element configurations, materials and orientations to achieve specific intended results to deliver additional oral health benefits, like enhanced cleaning tooth polishing, tooth whitening and/or massaging of the gums.

Preferably, the cleaning elements 20 are in-molded technology (IMT) bristles while the cleaning elements 30 are conventional fiber bristles.

The elastomer material covering shelf-like protrusions 28 could additionally include, for example, a soft gel material to which the cleaning elements 30 are directly mounted. It is preferable that the types of cleaning elements used on the shelf-like protrusions should be smaller in cross-section than the cleaning elements in the central section. This further enhances the flexibility since the cleaning elements 30 are more flexibly mounted by being on thin shelf-like protrusions in addition to being held by flexible elastomeric material.

As should be apparent the toothbrush 10 thus provides a head which is particularly flexible in use due to a number of different factors, each of which contributes to the desired results. This includes the segmented central section having varying cross-sectional areas and includes the use of at least two different materials with regard to their hardnesses and further includes the provision of the shelf-like protrusions to enhance flexibility.

Although FIGS. 1–3 illustrate a manually operated toothbrush, the invention may also be practiced where the head includes one or more power or electrically operated movable sections carrying cleaning elements. Such movable section may oscillate in a rotational manner or may oscillate linearly in a longitudinal direction with respect to the longitudinal axis of the head or may oscillate linearly in a lateral or transverse direction with respect to the longitudinal axis of the head. The movable section may oscillate in and out in a direction toward and away from the outer surface of the head. The movable section may rock back and forth with respect to the outer surface of the head. The movable section may rotate continuously in the same direction, rather than oscillate. Any suitable drive mechanism may be used for imparting the desired motion to the movable section. Where plural movable sections are used, all of the movable sections may have the same type and direction of movement, or combinations of different movements may be used.

Figure 4:
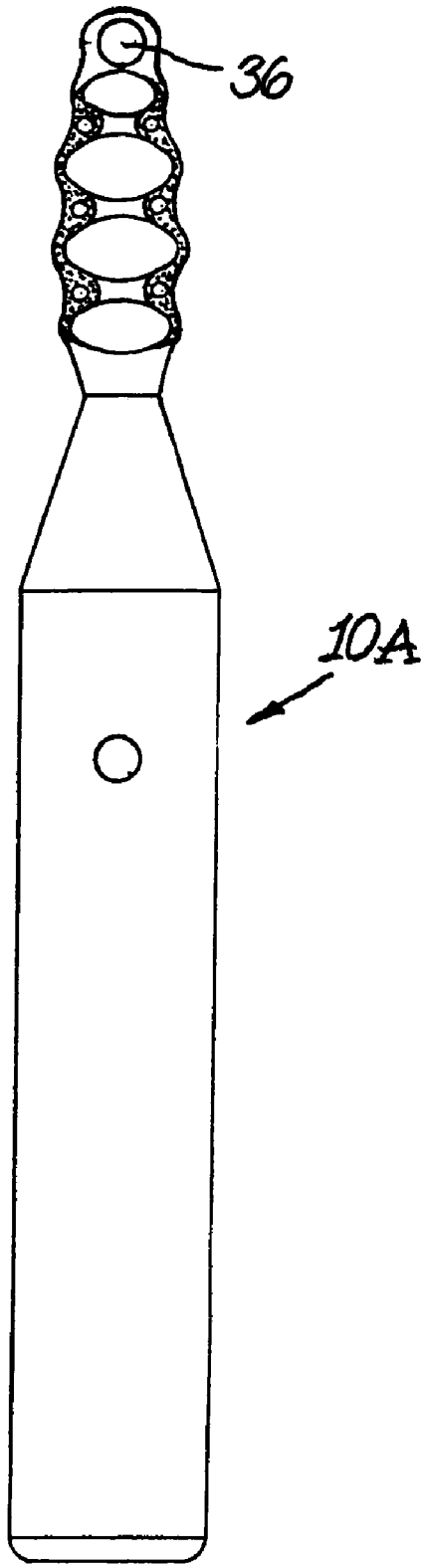
FIG. 4 is a front elevational view of a toothbrush in accordance with a further embodiment of this invention.

FIG. 4 illustrates a toothbrush 10A which includes a power driven movable disc or section 36 having cleaning elements. The movable section 36 could be oscillated rotationally such as by using the type of drive mechanism shown in U.S. Pat. No. 5,625,916, or could move in and out using the type of drive mechanism shown in U.S. Pat. No. Re 35,941, all of the details of both patents are incorporated herein by reference thereto. Alternatively, the other types of drives referred to above could move section 36 in other manners and directions. Although FIG. 4 shows movable section 36 to be at the distal end of the head, the movable section(s) could be located at any desired location on the head.

What is claimed is:

1. A toothbrush comprising a handle, an elongated head mounted to said handle, said head having an outer surface, said head having a longitudinal axis, said head having a longitudinal central section disposed along said longitudinal axis, said central section comprising a plurality of longitudinally disposed segments, each of said segments being connected to an adjacent segment by a joint, said central section is flexible along said joints, cleaning elements mounted to said segments and extending outwardly from said outer surface of said head, a shelf-like protrusion extending laterally outwardly from said central section on each side of said central section, and further cleaning elements flexibly mounted to said protrusions whereby said head is flexible during use, wherein said segments are flexibly mounted for movement along said longitudinal axis to result in a caterpillar-type movement of said central section, and said further cleaning elements are movable in a direction transverse to said longitudinal axis.

2. The toothbrush of claim 1 including an elastomer covering said outer surface of said protrusions, and said further cleaning elements being mounted to said elastomer.

3. The toothbrush of claim 2 wherein said central section is made of a harder material than said covered shelf-like protrusions, and shelf-like protrusions being thinner than said central section.

4. The toothbrush of claim 2 wherein said shelf-like protrusions move in a direction transverse to said longitudinal axis.

5. The toothbrush of claim 4 wherein said central section is made of a harder material than said covered shelf-like protrusions, and shelf-like protrusions being thinner than said central section.

6. The toothbrush of claim 5 wherein said elastomer covers all otherwise exposed surfaces of said shelf-like protrusions.

7. The toothbrush of claim 6 wherein said head has an undulated outer edge on each side of said head.

8. The toothbrush of claim 7 wherein each of said segments has a curved outer side edge whereby said central section is curved on each side.

9. The toothbrush of claim 8 wherein each of said segments is generally oval in shape, and each of said joints tapering inwardly from its area of connection with said segments to the central portion of said joint.

10. The toothbrush of claim 9 wherein said segments differ in size from each other.

11. The toothbrush of claim 10 wherein said further cleaning elements are tufts of bristles.

12. The toothbrush of claim 11 wherein said cleaning elements on said segments are in-molded technology bristles.

13. The toothbrush of claim 1 wherein said head has a face opposite to said outer surface, and said face being undulated with spaced portions of narrow thickness.

14. The toothbrush of claim 13 wherein each of said narrow thickness portions is disposed in line with a respective one of said joints.

15. The toothbrush of claim 1 wherein said shelf-like protrusions are movable in a direction transverse to said longitudinal axis.

16. The toothbrush of claim 1 wherein said head has an undulated outer edge on each side of said head, wherein each of said segments has a curved outer side edge whereby said central section is curved on each side.

17. The toothbrush of claim 1 wherein said head has a face opposite to said outer surface, and said face being undulated with spaced portions of narrow thickness, and each of said narrow thickness portions being disposed in line with a respective one of said joints.

* * * * *